US010096314B2

(12) United States Patent
Christoph

(10) Patent No.: US 10,096,314 B2
(45) Date of Patent: Oct. 9, 2018

(54) NOISE AND VIBRATION SENSING

(71) Applicant: HARMAN BECKER AUTOMOTIVE SYSTEMS GMBH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 19 days.

(21) Appl. No.: 15/266,731

(22) Filed: Sep. 15, 2016

(65) Prior Publication Data

US 2017/0076712 A1 Mar. 16, 2017

(30) Foreign Application Priority Data

Sep. 15, 2015 (EP) ..... 15185236

(51) Int. Cl.
*A61F 11/06* (2006.01)
*G10K 11/178* (2006.01)

(52) U.S. Cl.
CPC ..... *G10K 11/1788* (2013.01); *G10K 11/178* (2013.01); *G10K 2210/129* (2013.01);
(Continued)

(58) Field of Classification Search
CPC .. H04R 1/1066; H04R 2225/61; H04R 25/65; H04R 2225/41; H04R 2225/43;
(Continued)

(56) References Cited

U.S. PATENT DOCUMENTS 5,386,372 A * 1/1995 Kobayashi ..... B60G 17/018 700/280
6,324,290 B1 * 11/2001 Murakami ..... G01H 1/00 367/119

(Continued)

FOREIGN PATENT DOCUMENTS

DE 3644858 A1 12/2013
EP 0721178 A2 7/1996

(Continued)

OTHER PUBLICATIONS

European Search Report for corresponding Application No. 15185236.5, dated Mar. 16, 2016, 7 pages.

*Primary Examiner* — Akelaw Teshale
(74) *Attorney, Agent, or Firm* — Brooks Kushman P.C.

(57) ABSTRACT

A noise and vibration sensing system is provided. The sensing system includes an acceleration sensor arrangement and a summer module. The acceleration sensor arrangement includes at least one acceleration sensor and is configured to generate at least two sense signals representative of acceleration that acts on the acceleration sensor arrangement. The at least two sense signals includes dynamic ranges that are ratios between maximum amplitudes of the at least two sense signals and noise created by the acceleration sensor arrangement. The summer module is configured to sum up the at least two sense signals to provide a sum signal that includes noise and a dynamic range which is a ratio between a maximum amplitude of the sum signal and the noise included in the sum signal. The dynamic range of the sum signal is greater than the arithmetic mean of the dynamic ranges of the at least two sense signals.

20 Claims, 4 Drawing Sheets

(52) U.S. Cl.
CPC ..... *G10K 2210/12821* (2013.01); *G10K 2210/3027* (2013.01); *G10K 2210/3221* (2013.01)

(58) Field of Classification Search
CPC ..... H04R 2225/63; H04R 2430/21; H04R 2460/01; H04R 25/405; H04R 25/407; H04R 25/558; H04R 25/604; H04R 1/028; H04R 1/1083; H04R 1/2853; H04R 2420/09
USPC ..... 381/86, 57, 106, 107, 71.11, 71.4, 104, 381/312, 313, 317, 56, 58, 59, 71.1, 71.2, 381/71.8, 92, 94.1
See application file for complete search history.

(56) References Cited

U.S. PATENT DOCUMENTS

| | | | | |
|---|---|---|---|---|
| 9,404,899 | B1 * | 8/2016 | Konopka | G08B 13/1609 |
| 2007/0265736 | A1 * | 11/2007 | Mensler | G01H 17/00 701/1 |
| 2011/0142248 | A1 * | 6/2011 | Sakamoto | G10K 11/178 381/71.4 |
| 2012/0189132 | A1 * | 7/2012 | Sakamoto | G10K 11/178 381/71.4 |

FOREIGN PATENT DOCUMENTS

| | | | |
|---|---|---|---|
| EP | 0762146 | A1 | 3/1997 |
| EP | 2293116 | A2 | 3/2011 |
| GB | 2455410 | A | 6/2009 |

* cited by examiner

NOISE AND VIBRATION SENSING

CROSS-REFERENCE TO RELATED APPLICATIONS

This application claims priority to EP application Serial No. 15185236.5 filed Sep. 15, 2015, the disclosure of which is hereby incorporated in its entirety by reference herein.

TECHNICAL FIELD

The disclosure relates to noise and vibration sensing systems, particularly for use in active road noise control systems, active road noise control systems and noise and vibration sensing methods.

BACKGROUND

Land based vehicles, when driven on roads and other surfaces, generate low frequency noise known as road noise. Even in modern vehicles, cabin occupants may be exposed to road noise that is transmitted through the structure, e.g., tires-suspension-body-cabin path, and through airborne paths, e.g., tires-body-cabin path, to the cabin. It is desirable to reduce the road noise experienced by cabin occupants. Active Noise, vibration, and harshness (NVH) control technologies, also known as active road noise control (RNC) systems, can be used to reduce these noise components without modifying the vehicle's structure as in active vibration technologies. However, active sound technologies for road noise cancellation may require very specific noise and vibration (N&V) sensor arrangements throughout the vehicle structure in order to observe road noise related noise and vibration signals.

SUMMARY

An exemplary noise and vibration sensing system includes an acceleration sensor arrangement including at least one acceleration sensor and is configured to generate at least two sense signals representative of the acceleration that acts on the acceleration sensor arrangement, wherein the sense signals have dynamic ranges which are the ratios between maximum amplitudes of the sense signals and noise created by the acceleration sensor arrangement. The noise and vibration sensing system further includes a summer module configured to sum up the at least two sense signals to provide a sum signal. The sum signal includes noise created by the acceleration sensor arrangement and the sum signal has a dynamic range which is the ratio between a maximum amplitude of the sum signal and the noise included in the sum signal. The dynamic range of the sum signal is greater than an arithmetic mean of the dynamic ranges of the sense signals.

An exemplary road noise control system includes a noise and vibration sensing system, a road noise control module and at least one loudspeaker.

An exemplary noise and vibration sensing method includes generating, with an acceleration sensor arrangement, at least two sense signals representative of at least one of accelerations, motions and vibrations that act on the acceleration sensor arrangement. The sense signals have dynamic ranges that are ratios between maximum amplitudes of the sense signals and noise created by the acceleration sensor arrangement. The method further includes summing up the at least two sense signals to provide a sum signal. The sum signal includes noise created by the acceleration sensor arrangement. The sum signal has a dynamic range which is the ratio between a maximum amplitude of the sum signal and the noise included in the sum signal. The dynamic range of the sum signal is greater than an arithmetic mean of the dynamic ranges of the sense signals.

BRIEF DESCRIPTION OF THE DRAWINGS

The disclosure may be better understood from reading the following description of non-limiting embodiments to the attached drawings, in which like elements are referred to with like reference numbers, wherein below.

DETAILED DESCRIPTION

Noise and vibration sensors provide reference inputs to active RNC systems, for example, multichannel feedforward active road noise control systems, as a basis for generating the anti-noise that reduces or cancels road noise. Noise and vibration sensors may include acceleration sensors such as accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting magnitude and direction of the proper acceleration, and can be used to sense orientation, coordinate acceleration, motion, vibration, and shock.

Airborne and structure-borne noise sources are monitored by the noise and vibration sensors in order to provide the highest possible road noise reduction (cancellation) performance between 0 Hz and 1 kHz. For example, acceleration sensors used as input noise and vibration sensors may be disposed across the vehicle to monitor the structural behavior of the suspension and other axle components for global RNC. Above a frequency range that stretches from 0 Hz to approximately 500 Hz, acoustic sensors that measure the airborne road noise may be used as reference control inputs. Furthermore, two microphones may be placed in the headrest in close proximity of the passenger's ears to provide an error signal or error signals in case of binaural reduction or cancellation. The feedforward filters are tuned or adapted to achieve maximum noise reduction or noise cancellation at both ears.

Figure 1:
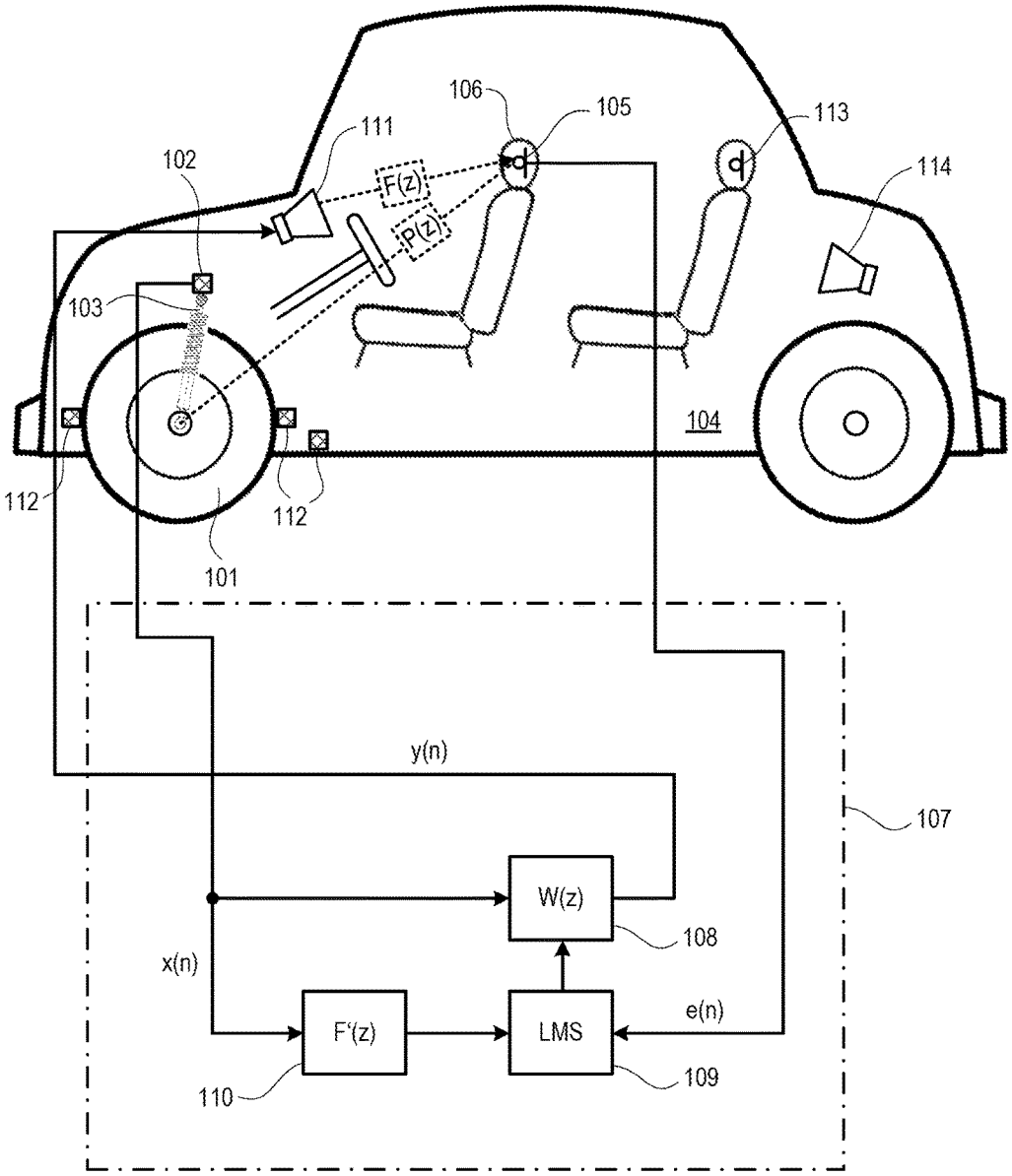
FIG. 1 is a schematic diagram illustrating an exemplary simple single-channel active road noise control system.

A simple single-channel feedforward active RNC system may be constructed as shown in FIG. 1. Vibrations that originate from a wheel 101 moving on a road surface are detected by a suspension acceleration sensor 102 which is mechanically coupled with a suspension device 103 of an automotive vehicle 104 and which outputs a noise and vibration signal x(n) that represents the detected vibrations and, thus, correlates with the road noise audible within the cabin. At the same time, an error signal e(n) representing noise present in the cabin of the vehicle 104 is detected by a microphone 105 arranged within the cabin in a headrest 106 of a seat (e.g., the driver's seat). The road noise originating from the wheel 101 is mechanically transferred to the microphone 105 according to a transfer characteristic P(z).

A transfer characteristic W(z) of a controllable filter 108 is controlled by an adaptive filter controller 109 which may operate according to a known least mean square (LMS) algorithm based on the error signal e(n) and on the road noise signal x(n) filtered with a transfer characteristic F'(z) by a filter 110, wherein W(z)=−P(z)/F(z). F'(z)=F(z) and F(z) represents the transfer function between a loudspeaker and the microphone 105. A signal y(n) having a waveform inverse in phase to that of the road noise audible within the cabin is generated by an adaptive filter formed by controllable filter 108 and filter controller 109, based on the thus identified transfer characteristic W(z) and the noise and vibration signal x(n). From signal y(n) a waveform inverse in phase to that of the road noise audible within the cabin is then generated by the loudspeaker 111, which may be arranged in the cabin, to thereby reduce the road noise within the cabin. The exemplary system described above employs a straightforward single-channel feedforward filtered-x LMS control structure 107 for the sake of simplicity, but other control structures, for example, multi-channel structures with a multiplicity of additional channels, a multiplicity of additional noise sensors 112, a multiplicity of additional microphones 113, and a multiplicity of additional loudspeakers 114, may be applied as well.

Figure 2:
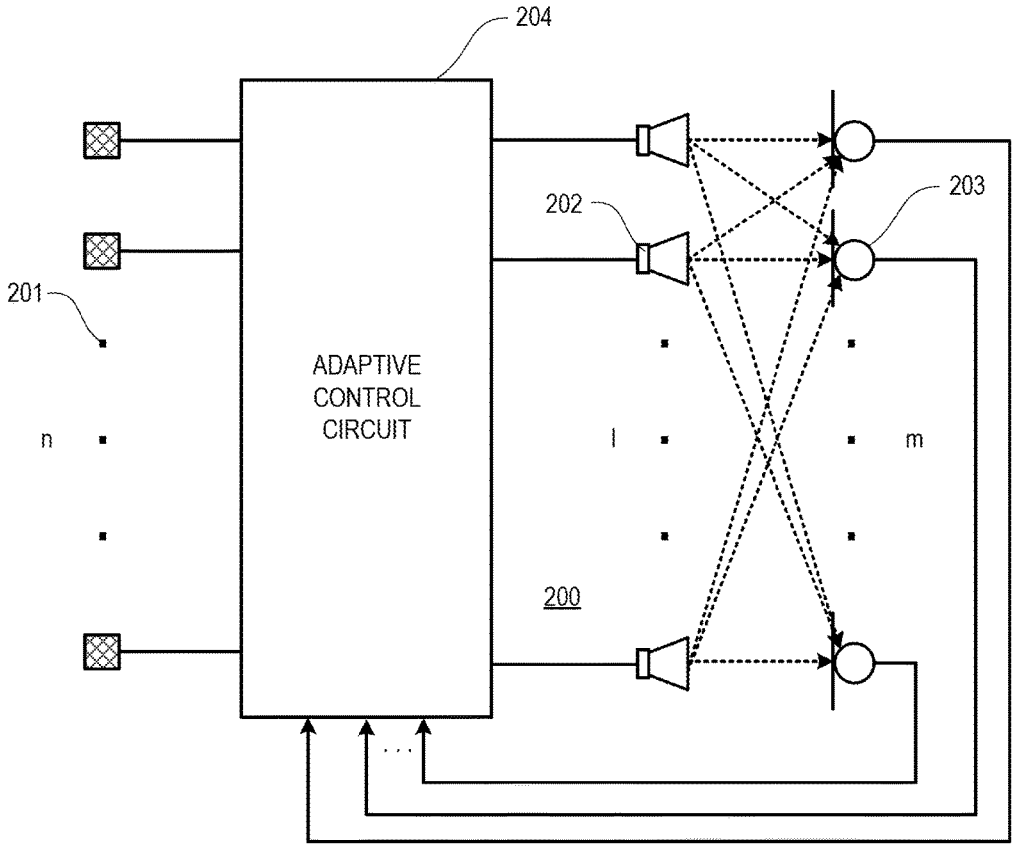
FIG. 2 is a schematic diagram illustrating an exemplary simple multi-channel active road noise control system.

FIG. 2 shows an active road noise control system 200 which is a multi-channel type active road noise control system capable of suppressing noise from a plurality of noise and vibration sources. The active road noise control system 200 comprises a multiplicity n of noise and vibration sensors 201, a multiplicity 1 of loudspeakers 202, a multiplicity m of microphones 203, and an adaptive control circuit 204 which operates to minimize the error between noise from the noise and vibration sources (primary noise) and cancelling noise (secondary noise). The adaptive control circuit 204 may include a number of control circuits provided for each of the loudspeakers 202, which create cancelling signals for cancelling noise from corresponding noise and vibration sources.

In conventional active RNC systems, the frequency range of noise to be reduced is limited to a low frequency range. That is, the conventional systems are not intended to reduce noise over its entire frequency range. Further, adaptive digital filters used in these systems have such characteristics as to be able to reduce only low frequency noise components, although processing noise over a wide frequency range is desired. In the active RNC systems disclosed herein, careful arrangement of the sensors allows for more sensitivity and a broader operating frequency range.

RNC systems as described above may exhibit a limited noise reduction capability when the acceleration sensors' dynamic ranges, i.e., the ratios between maximum amplitudes of signals output by the sensors and noise that originates from the sensors and that is contained in the signals output by the sensors (i.e., signal-to-noise ratio), are not sufficient, as is the case with conventional acceleration sensors used for suspension set-up and vibration control. However, it is rather costly to provide sensors with better dynamic ranges. In the following, simple ways are described that allow for using acceleration sensors with minor dynamic ranges in active road noise systems.

Figure 3:
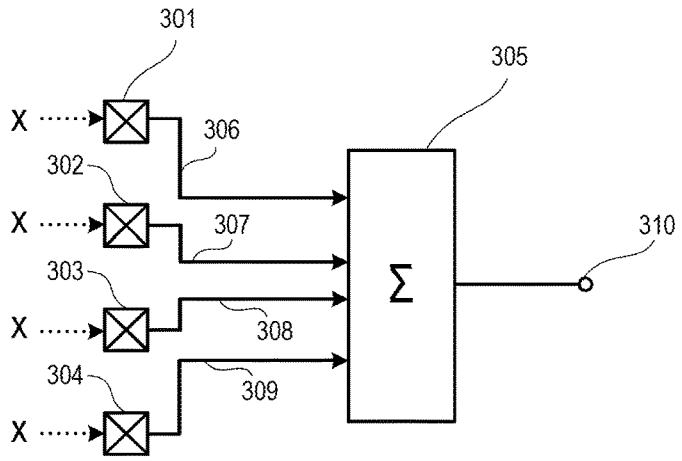
FIG. 3 is a schematic diagram illustrating an exemplary sensor arrangement with multiple single-axis sensors.

Referring to FIG. 3, a multiplicity of (i.e., at least two) acceleration sensors, which is in the present example four (identical) acceleration sensors 301-304, are connected to a summer module 305 which sums up sense signals 306-309 provided by the acceleration sensors 301-304 and outputs a sum signal 310 representative of the sum of sense signals 306-309. The acceleration sensors 301-304 may be unidirectional sensors, i.e., sensors that have their maximum sensitivity only in one single direction such as a direction x of a given coordinate system x-y-z (referred to herein as pointing in this direction). In contrast, multi-directional sensors have their maximum sensitivities in at least two directions but not in all directions. For example, a two-directional sensor has two sensitivity maxima in two different (perpendicular) directions. Omni-directional sensors have approximately constant sensitivities independent of the direction. In the example shown in FIG. 3, the acceleration sensors 301-304 may form a sensor arrangement in which all sensors are unidirectional and point in the same direction x or may, alternatively, point in different directions.

Figure 4:
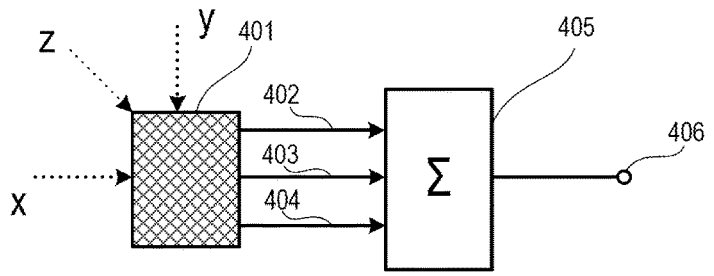
FIG. 4 is a schematic diagram illustrating an exemplary sensor arrangement with a multi-axis sensor.

FIG. 4 shows a three-directional acceleration sensor 401 with three sensitivity maxima in three different (perpendicular) directions x, y and z. The acceleration sensor 401 generates three sense signals 402-404 which are summed up by a summing module 405 to provide a sum signal 406. Instead of the three-directional acceleration sensor 401 three unidirectional sensors, each pointing in one of the three directions x, y and z, may be used.

Figure 5:
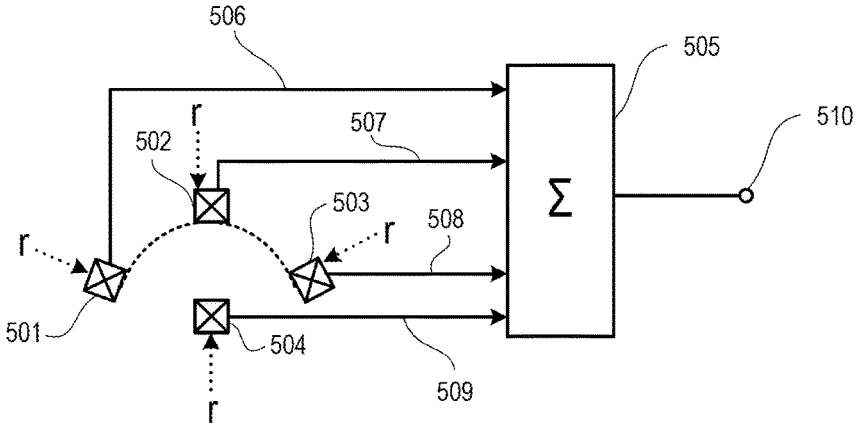
FIG. 5 is a schematic diagram illustrating an exemplary sensor arrangement with multiple sensors arranged in specific pattern.

Furthermore, an array with a multiplicity of (e.g., four) acceleration sensors 501-504, which are arranged in a specific pattern, for example, evenly distributed over a virtual or real sphere's surface and pointing radial (r) outward from the sphere, may be employed as shown in FIG. 5. A summing module 505 receives sense signals 506-509 from the acceleration sensors 501-504, sums them up and provides a sum signal 510 representative of the sum of the sense signals 506-509.

Figure 6:
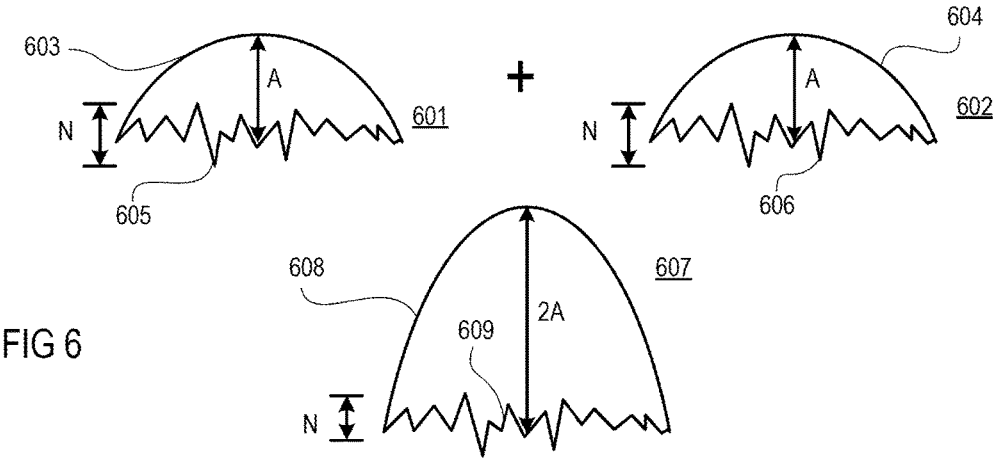
FIG. 6 is a diagram illustrating two exemplary sense signals, each of which having a harmonic component and a noise component.

FIG. 6 illustrates two exemplary sense signals 601 and 602, each of which have a harmonic component 603, 604 such as a (pure) sinus signal, and a noise component 605, 606. The harmonic components 603 and 604 may have a power A and the noise may have a power N. When summing up the sense signals 601 and 602, a sum signal 607 is obtained in which the harmonic components 603 and 604 add to a harmonic component 608 of sum signal 607 and noise components 605 and 606 are combined to provide a noise component 609 of sum signal 607. The power of the noise component 609 is almost the same as either noise component 605 or noise component 609 since the summation of random signals such as noise does not increase the power of the summed noise significantly due to the random amplitudes of the noise components. However, with harmonic signals such as sinus signals, the power of the sum of two identical sinus signals is twice the power that one signal has, so that when summing up mixed signals with harmonic and random components the dynamic range increases. In general, the increase I in dynamic range (or signal-to-noise ratio) can be described as: $I[dB]=10 \log_{10}N$, wherein N is the number of sensors combined.

Figure 7:
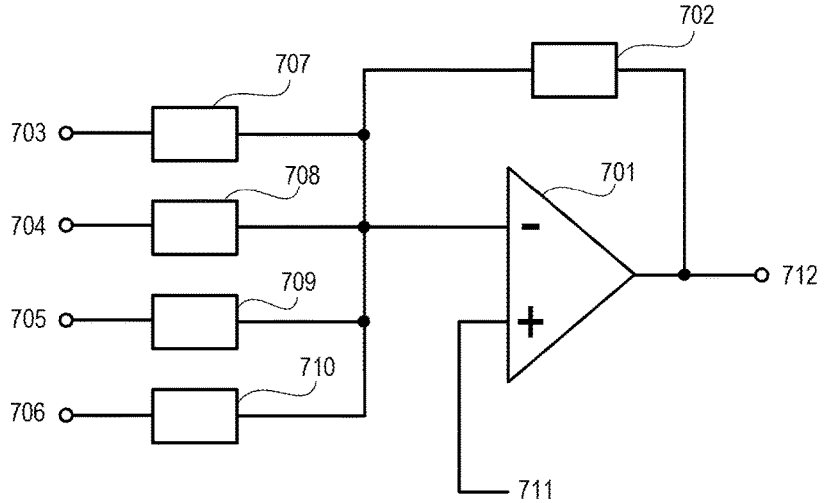
FIG. 7 is a block diagram illustrating an exemplary summing circuit.

The summing modules 305, 405 and 505 may include, in case of digital signal processing, simple digital hardware adders or signal processors that perform respective adding operations, or may include, in case of analog signal processing, analog summing circuits such as the example circuit shown in FIG. 7. In the summing circuit shown in FIG. 7, an operational amplifier 701 has an inverse input, a non-inverse input and an output. An ohmic resistor 702 is connected between output and inverse input of operational amplifier 701 to provide a feedback path. Sense signals 703-706 from four acceleration sensors (not shown) are supplied via ohmic resistors 707-710 to the inverse input of operational amplifier 701. The non-inverse input of operational amplifier 701 is connect to ground 711 and the output of operational amplifier 701 forms an output 712 of the analog summing module. Assuming that an output voltage $U_{out}$ is provided at output 712 and that the sense signals 703-706 provide identical input voltages, namely input voltage $U_{in}$, and further assuming that the resistors 707-710 have the same resistance $R_{in}$ and resistor 702 has a resistance Rout, the output voltage $U_{out}$ is as follows:

$$U_{out} = -\sum_{1}^{N} \frac{R_{out}}{R_{in}} U_{in}.$$

Figure 8:
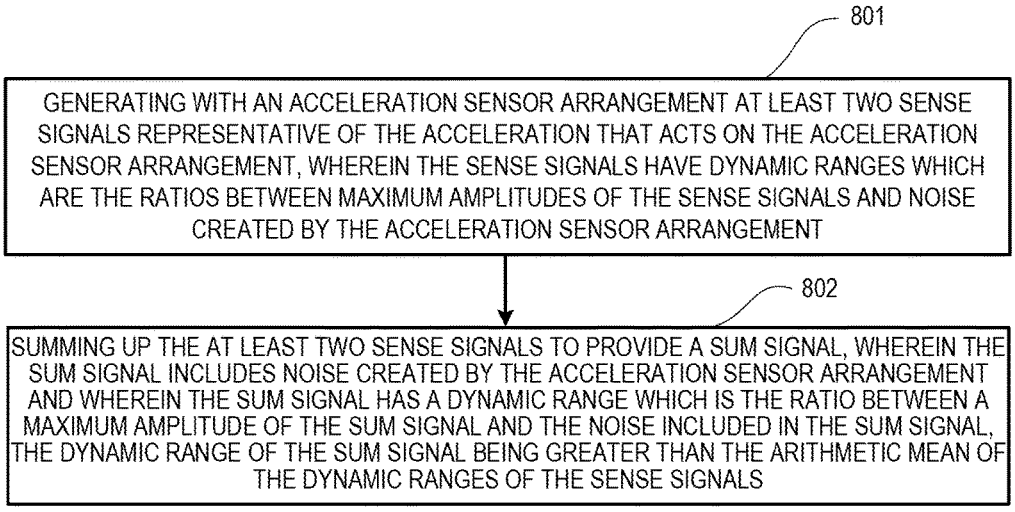
FIG. 8 is a flow chart illustrating an exemplary noise and vibration sensing method.

Referring to FIG. 8, an exemplary noise and vibration sensing method may include (801) generating with an acceleration sensor arrangement at least two sense signals representative of the acceleration that acts on the acceleration sensor arrangement, wherein the sense signals have dynamic ranges which are the ratios between maximum amplitudes of the sense signals and noise created by the acceleration sensor arrangement, and (802) summing up the at least two sense signals to provide a sum signal, wherein the sum signal includes noise created by the acceleration sensor arrangement and wherein the sum signal has a dynamic range which is the ratio between a maximum amplitude of the sum signal and the noise included in the sum signal, the dynamic range of the sum signal being greater than the arithmetic mean of the dynamic ranges of the sense signals.

In RNC applications acceleration sensors are used as noise and vibration sensors, delivering the desired reference signals. If those signals exhibit a considerable noise floor, which is noise generated by the sensors themselves in contrast to noise and vibrations to be measured, and thus exhibit a small dynamic range, the whole RNC system is doomed to fail. However, acceleration sensors and acceleration sensor arrangements often output a multiplicity of sense signals. If sensor signals stem from multi-axis sensors or sensor arrangements mounted at almost the same local area and/or having the same orientation (x, y or z axis), these signals may be combined as described above to increase the system's dynamic. Thus, an underperforming RNC system may be enhanced by combining appropriate sense signals of a multiplicity of under-performing sensors. Furthermore, multiple cheap low-performing acceleration sensors may be used instead of a single expensive high-performing acceleration sensor to reduce overall costs, balancing out sensor costs and differences in their performance.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

What is claimed is:

1. A noise and vibration sensing system comprising:

an acceleration sensor arrangement comprising at least one acceleration sensor and configured to generate at least two sense signals representative of the acceleration that acts on the acceleration sensor arrangement, wherein the at least two sense signals have dynamic ranges which are ratios between maximum amplitudes of the at least two sense signals and noise created by the acceleration sensor arrangement; and a summer configured to sum up the at least two sense signals to provide a sum signal, wherein the sum signal includes noise created by the acceleration sensor arrangement and wherein the sum signal has a dynamic range which is a ratio between a maximum amplitude of the sum signal and the noise included in the sum signal, the dynamic range of the sum signal being greater than an arithmetic mean of the dynamic ranges of the at least two sense signals, and wherein the dynamic range of the sense signal increases sensor capability for a noise and vibration sensing system.

2. The noise and vibration sensing system of claim 1, wherein the acceleration sensor arrangement comprises at least two unidirectional acceleration sensors, each of the at least two unidirectional acceleration sensors is configured to generate one sense signal.

3. The noise and vibration sensing system of claim 1, wherein the acceleration sensor arrangement comprises at least one multi-directional acceleration sensor configured to generate the at least two sense signals.

4. The noise and vibration sensing system of claim 1, wherein the acceleration sensor arrangement comprises an array of adjacent acceleration sensors.

5. The noise and vibration sensing system of claim 1, wherein the acceleration sensor arrangement comprises acceleration sensors that have identical directions.

6. The noise and vibration sensing system of claim 1, wherein the acceleration sensor arrangement comprises identical sensors.

7. The noise and vibration sensing system of claim 6, wherein the acceleration sensor arrangement comprises acceleration sensors that have different directions.

8. A road noise control system including the noise and vibration sensing system according to claim 1 and a road noise control module and at least one loudspeaker.

9. A noise and vibration sensing method comprising:

generating with an acceleration sensor arrangement, at least two sense signals representative of at least one of accelerations, motions and vibrations that act on the acceleration sensor arrangement, wherein the at least two sense signals have dynamic ranges which are ratios between maximum amplitudes of the at least two sense signals and noise created by the acceleration sensor arrangement; and summing up the at least two sense signals to provide a sum signal, wherein the sum signal includes noise created by the acceleration sensor arrangement and wherein the sum signal has a dynamic range which is a ratio between a maximum amplitude of the sum signal and the noise included in the sum signal, the dynamic range of the sum signal being greater than an arithmetic mean of the dynamic ranges of the sense signals, and wherein the dynamic range of the sense signal increases sensor capability for a noise and vibration sensing system.

10. The noise and vibration sensing method of claim 9, wherein the at least two sense signals are generated with at least two unidirectional acceleration sensors, each unidirectional acceleration sensor of the at least two unidirectional acceleration sensors is configured to generate one sense signal.

11. The noise and vibration sensing method of claim 9, wherein the at least two sense signals include are generated with at least one multi-directional acceleration sensor.

12. The noise and vibration sensing method of claim 9, wherein the at least two sense signals are generated with an array of adjacent acceleration sensors.

13. The noise and vibration sensing method of claim 9, wherein the at least two sense signals are generated with acceleration sensors having identical directions.

14. The noise and vibration sensing method of claim 9, wherein the at least two sense signals are generated with identical sensors.

15. The noise and vibration sensing method of claim 14, wherein the acceleration sensor arrangement comprises acceleration sensors that have different directions.

16. A noise and vibration sensing system comprising:

an acceleration sensor arrangement including at least one acceleration sensor and being configured to generate a plurality of sense signals representative of an acceleration that acts on the acceleration sensor arrangement, wherein the plurality of sense signals include noise and dynamic ranges that correspond to ratios between maximum amplitudes of the plurality of sense signals; and a summer configured to generate a sum signal in response to the plurality of sense signals, wherein the sum signal includes noise and has a dynamic range which is a ratio between a maximum amplitude of the sum signal and the noise included in the sum signal, wherein the dynamic range of the sum signal is greater than an arithmetic mean of the dynamic ranges of the plurality of sense signals, and wherein the dynamic range of the sense signal increases sensor capability for a noise and vibration sensing system.

17. The noise and vibration sensing system of claim 16, wherein the acceleration sensor arrangement includes at least two unidirectional acceleration sensors, each unidirectional acceleration sensor of the at least two unidirectional acceleration sensors is configured to generate a single sense signal.

18. The noise and vibration sensing system of claim 16, wherein the acceleration sensor arrangement includes at least one multi-directional acceleration sensor that is configured to generate the plurality of sense signals.

19. The noise and vibration sensing system of claim 16, wherein the acceleration sensor arrangement includes an array of adjacent acceleration sensors.

20. The noise and vibration sensing system of claim 16, wherein the acceleration sensor arrangement includes acceleration sensors that have identical directions.

* * * * *